US005759627A

United States Patent [19]

Kokubo et al.

[11] Patent Number: 5,759,627

[45] Date of Patent: Jun. 2, 1998

[54] COATING APPARATUS

[75] Inventors: Sachiko Kokubo, Tokyo; Takeshi Nakajima; Eiten Chin, both of Ichigai-machi, all of Japan

[73] Assignee: Kao Corporation, Tokyo, Japan

[21] Appl. No.: 623,010

[22] Filed: Mar. 28, 1996

[30] Foreign Application Priority Data

Mar. 31, 1995 [JP] Japan ..... 7-097632

[51] Int. Cl.[6] ..... B05D 3/12

[52] U.S. Cl. ..... 427/356; 118/410

[58] Field of Search ..... 118/419, 410, 118/411; 427/356, 128

[56] References Cited

U.S. PATENT DOCUMENTS

| | | | |
|---|---|---|---|
| 3,227,136 | 1/1966 | Bartlett et al. . | |
| 4,465,707 | 8/1984 | Tanaka et al. . | |
| 5,209,954 | 5/1993 | Takahashi et al. | 118/410 |
| 5,397,600 | 3/1995 | Shibata et al. | 118/410 |
| 5,501,737 | 3/1996 | Takahashi et al. | 118/410 |

FOREIGN PATENT DOCUMENTS

| | | |
|---|---|---|
| 52-22039 | 2/1977 | Japan . |
| 53-36458 | 4/1978 | Japan . |
| 1 389 074 | 4/1975 | United Kingdom . |

*Primary Examiner*—Brenda A. Lamb

*Attorney, Agent, or Firm*—Oblon, Spivak, McClelland, Maier Neustadt, P.C.

[57] ABSTRACT

A coating apparatus 10 is disclosed, which comprises a slot 18 and a chamber 17 formed upstream the slot 18 such as to distribute a coating liquid 12 in a coating width direction. The coating liquid is coated such that it is pressed against a web 11 as it is discharged from the slot. The slot gap H of the slot and the slot gap error ΔH in the coating width direction satisfies a relation $$\Delta H/H \leqq 0.05$$

and the pressure loss Pb of the coating liquid flowing in the chamber in the coating width direction, and the pressure loss Ps flowing in the slot satisfies a relation as follows.

$$Pb/Ps \leqq 0.15$$

6 Claims, 5 Drawing Sheets

COATING APPARATUS

BACKGROUND OF THE INVENTION

1. Field of the Invention

This invention relates to a coating apparatus for coating a coating liquid on a running support. According to the present invention, the support may be a sheet or a web of plastics, paper, cloth, metals, etc., and the coating liquid may be magnetic dispersoids, light-sensitive liquids, thermosensitive dispersoids and adhesive liquids, etc. for manufacturing magnetic recording mediums, photographic films, heat-sensitive papers, adhesive tapes, respectively.

2. Discussion of the Relating Art

Various coating apparatus have heretofore been used for coating, and among these coating apparatus, an extrusion die coating apparatus (hereinafter referred to as "die") finds applications in various fields. In this extrusion die coating apparatus ("die"), it is one of the important design elements to distribute the coating liquid uniformly in a coating width direction. Among such dies are a T die, a coat hanger chamber die, a multiple chamber die and a paint circulation die.

(a) T die

The T die usually has a cylindrical chamber having a relatively large volume. In this die, the resistance offered against coating liquid flowing in the chamber in the coating width direction is reduced to suppress thickness fluctuations of the coating film in the coating width direction.

In this die, however, coating liquid flows slowly in the chamber, and when the coating liquid is a dispersion coating liquid such as a magnetic dispersoid coating liquid, coagulation of the coating liquid may proceed to deteriorate the surface properties of the coating film.

(b) Coat hanger chamber die

The coat hanger chamber die has a chamber having a shape of a coat hanger. The flow speed of coating liquid which flows in the chamber in the coating width direction is held to be more than a proper value to cause uniform distribution of the coating liquid in the coating width direction so as to suppress thickness fluctuations of the coating film in the coating width direction. In addition, a shearing force is given to the coating liquid flowing in the chamber to suppress coagulation of the coating liquid so as to provide for satisfactory surface properties thereof.

In order to attain the coating film thickness fluctuation suppression and surface property improvement, however, it is necessary to design the die by accurately grasping the flow properties of the coating liquid. In addition, the designed die is applicable only in very narrow ranges of coating operation conditions (such as coating speed, coating thickness, viscosity of the coating liquid, etc.).

(c) Multiple chamber die

This die has a plurality of chamber stages provided in series, as disclosed in Japanese Patent Laid-Open Publication (JP-A) No. Showa 53-36458 and British Patent No. 1,389,074. In this die, each chamber volume, each slot gap and each slot length are optimized to provide for satisfactory coating liquid distribution property in the coating width direction to suppress thickness fluctuations of the coating film in the coating width direction. In addition, a shearing force is given to the coating liquid to suppress coagulation thereof so as to improve the surface properties of the coating film.

However, increasing the shearing force given to the coating liquid necessitates reducing the chamber volume and slot gap. This may lead to thickness fluctuations of the coating film in the coating width direction.

(d) Paint circulation die

In this die, coating liquid is partly discharged to the outside from a position other than the slot, thus positively causing flow of the coating liquid to give a shearing force thereto, as disclosed in Japanese Patent Laid-Open Publication (JP-A) No. Showa 52-22039 and U.S. Pat. No. 4,465,707. In a further die different from the paint circulation die, as disclosed in U.S. Pat. No. 3,227,136, a shearing force is given to the coating liquid in a chamber by causing rotation of a cylinder which is provided in the chamber.

In the above paint circulation die or the like, however, it is necessary to add a pump and piping, thus complicating the structure of the apparatus.

While the various dies noted above have their own merits and demerits, in either of them it is a first purpose to obtain uniform thickness coating in the coating width direction, and it is a second purpose to obtain surface property improvement of the coating film.

Recently, thickness reduction of the coating film is demanded, and this demand is leading to a narrower slot gap of the slot. By making the slot gap narrower, however, the influence of the processing accuracy of the slot gap, i.e., parallelness of the slot in the coating width direction, on the thickness fluctuations is extremely increased. In the design of the prior art dies, no consideration has been given to the parallelness of the slot gap.

SUMMARY OF THE INVENTION

The invention has been made in the light of the above circumstances, and it has an object of providing a coating apparatus, which permits realizing a coating film having a uniform thickness in the coating width direction while the parallelness of the slot gap is taken into consideration.

A coating apparatus according to one aspect of the invention comprises a slot formed between two lips. The slot has a uniform slot gap in a coating width direction, and extends from a chamber formed upstream of the slot. The apparatus distributes a coating liquid in the coating width direction, the coating liquid being coated on a support proceeding past the lips such that it is pressed against the support as it is discharged from the slot, wherein:

the slot gap H of the slot and the slot gap error ΔH in the coating width direction satisfy a relation $$\Delta H/H \leqq 0.05$$

and the pressure loss Pb of the coating liquid flowing in the chamber in the coating width direction and the pressure loss Ps of the coating liquid flowing in the slot satisfies a relation as follows.

$$Pb/Ps \leqq 0.15$$

A coating apparatus according to another aspect of the invention is one wherein relations $$\Delta H/H \leqq 0.03 \text{ and}$$

$$Pb/Ps \leqq 0.06$$

are satisfied when the coating liquid is a dispersion coating liquid.

According to one aspect of the invention, the following effects are obtainable.

With the setting of the accuracy (or parallelness) ΔH/H of the slot gap defined by the slot gap H and the slot gap error ΔH in the coating width direction in a range of $$\Delta H/H \leqq 0.05 \quad (1)$$

it is possible to suppress to the utmost the coating film thickness fluctuations in the coating width direction based on the machining accuracy ΔH/H of the slot gap. The coating film thickness fluctuations in the coating width direction can be further suppressed with the setting of the relation of the pressure loss Pb of the coating liquid flowing in the chamber in the coating width direction and the pressure loss Ps of the coating liquid flowing in the slot to be in a range of $$Pb/Ps \leqq 0.15 \quad (2)$$

A stable coating can be realized by the setting of ΔH/H and Pb/Ps in the above ranges not individually but in a combined fashion. In other words, it is possible to realize a coating film having a uniform thickness in the coating width direction with the accuracy (or parallelness) of the slot gap taken into consideration with the pressure loss.

Generally, the thickness distribution in the coating width direction can be made more uniform by reducing Pb/Ps. Pb/Ps may be reduced by reducing Pb or by increasing Ps. Pb can be reduced by increasing the volume of the chamber. However, apparatus scale restriction dictates a lower limit of the design value of Pb. Ps can be increased by increasing the slot length or reducing the slot gap H. However, the dependency of Ps on the slot length is low, and like the chamber volume, the slot length is limited by equipment restrictions. Due to the limitation of the equation (1), the slot gap H can not be simply reduced although the reduction is desirable. The equation (2) provides the extent of reduction of Pb/Ps, i.e., the permissible limit of the chamber size, slot length, slot gap, etc., for obtaining satisfactory coating.

According to another aspect of the invention, the following effects are obtainable.

A dispersion coating liquid usually has a pseudoplastic property and is prone to thickness fluctuations of coating film in the coating width direction. In this case, by setting $$\Delta H/H \leqq 0.03 \text{ and}$$

$$Pb/Ps \leqq 0.06$$

it is possible to realize a coating film having a uniform thickness in the coating width direction with the accuracy (or parallelness) of the slot gap taken into consideration with the pressure loss.

The dispersion coating liquid further usually has a coagulation property. In order to obtain satisfactory surface properties of its coating film, therefore, it is desired to be in a flowing state in the chamber as well. This dictates a further upper limit on the chamber volume, so that Pb is increased. In the case of the dispersion coating liquid, however, unlike a coating liquid close to Newtonean coating liquids, the film thickness tends to be non-uniform in the coating width direction. In this case, when uniform thickness distribution is a first purpose, the upper limit of Pb/Ps is 0.06.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

Preferred embodiments of the invention will now be described with reference to the drawings.

Figure 1:
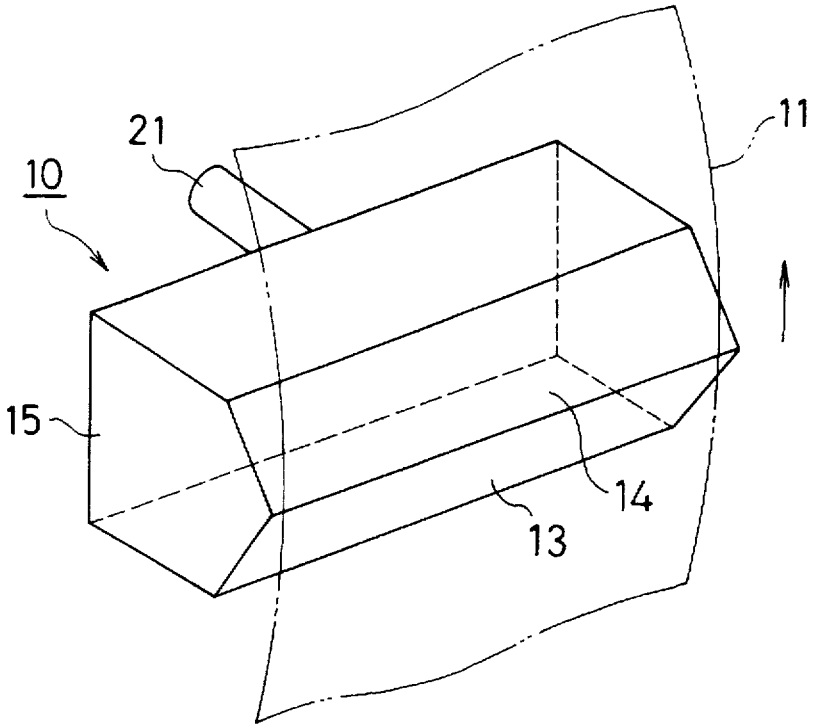
FIG. 1 is a perspective view showing die head in a first embodiment of the coating apparatus according to the invention.
Figure 2:
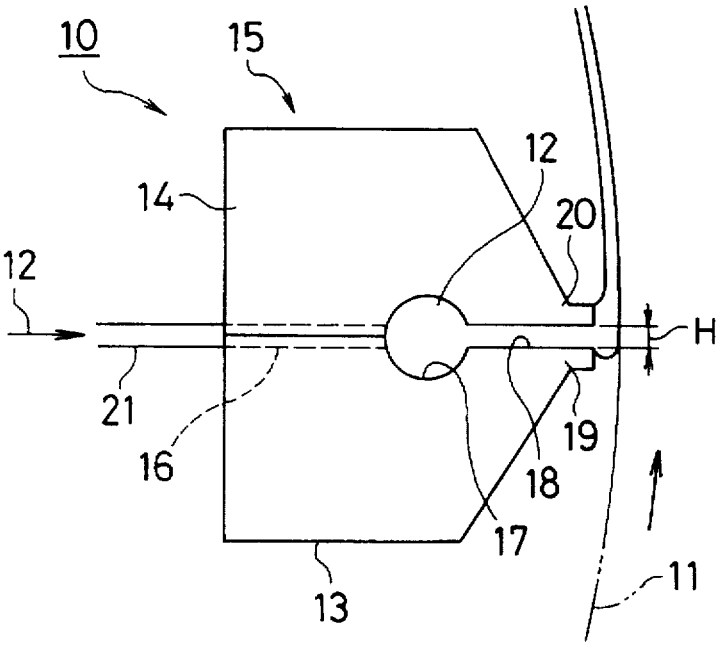
FIG. 2 is a sectional view showing the FIG. 1 die head.

FIGS. 1 and 2 show a coating apparatus 10 embodying the invention.

This coating apparatus 10 is a T die for coating a coating liquid 12 on a continuously proceeding support web 11. It is possible to use flexible sheets or like of plastics, paper, cloth, metals, etc. as the support web 11. The coating liquid 12 may be magnetic dispersoids, light-sensitive liquids, thermosensitive dispersoids, adhesive liquids, etc.

The coating apparatus 10 has a die head 15 which is constructed by bonding together an upstream block 13 and a downstream block 14. A coating liquid inlet 16, a chamber 17 and a slot 18 are defined between the bonded portions of the upstream and downstream blocks 13 and 14. The upstream and downstream blocks 13 and 14 have upstream and downstream lips 19 and 20 formed along their tips. The slot 18 is formed between the upstream and downstream lips 19 and 20 and is communicated with the chamber 17, which is in turn communicated with the coating liquid inlet 16. Coating liquid 12 is supplied from a coating liquid feeder 21 to the coating liquid inlet 16. That is, the coating liquid 12 is caused to flow from the coating liquid feeder 21 through the coating liquid inlet 16 to the chamber 17 and thence through the slot 18 to be coated continuously on the web 11 proceeding past the upstream and downstream lips 19 and 20.

The upstream and downstream lips 19 and 20, chamber 17 and slot 18 have substantially the same width as the web 11. The chamber 17 has a cylindrical shape and distributes the coating liquid 12 from the coating liquid inlet 16 such that the coating liquid 12 is supplied uniformly in amount in the coating width direction to the slot 18.

The slot 18 is formed as a flat parallel narrow path. It can function in cooperation with the chamber 17 to coat the coating liquid 12 uniformly in the coating width direction.

Figure 3:
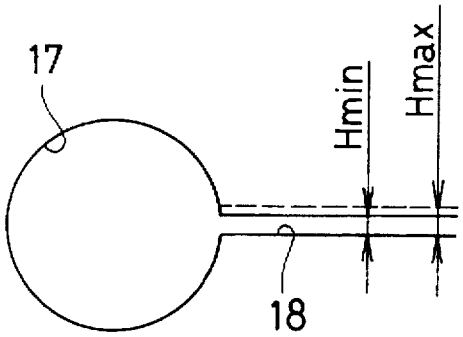
FIG. 3 is an enlarged scale view showing a portion of FIG. 2.

The slot gap H of the slot 18 varies with the subject of coating, but usually is set from several 10 μm to several mm. Referring to FIG. 3, the slot gap H is defined as $$H=\frac{1}{2}\times(Hmax+Hmin)$$

where Hmax and Hmin are maximum and minimum values of the slot gap in the coating width direction respectively. The slot gap error ΔH in the coating width direction is defined as follows.

$$\Delta H=Hmax-Hmin$$

The thickness fluctuations of the coating film in the coating width direction and also the surface properties of the coating film, are affected by the parallelness of the slot gap H in the coating width direction, i.e., the accuracy ΔH/H of the slot gap H, and also by the ratio Pb/Ps of the pressure loss Pb of the coating liquid 12 flowing in the chamber 17 in the coating width direction to the pressure loss Ps of the coating liquid 12 flowing in and out of the slot 18 (specifically in the direction perpendicular to the coating width direction).

The accuracy ΔH/H of the slot gap H is set in a range as follows.

$$\Delta H/H \leqq 0.05 \quad (1)$$

And the pressure loss ratio Pb/Ps is set in a range as follows.

$$Pb/Ps \leqq 0.15 \quad (2)$$

Generally, the thickness distribution in the coating width direction can be made more uniform by reducing Pb/Ps. Pb/Ps may be reduced by reducing Pb or by increasing Ps. Pb can be reduced by increasing the volume of the chamber. However, apparatus scale restriction dictates a lower limit of the design value of Pb. Ps can be increased by increasing the slot length or reducing the slot gap H. However, the dependency of Ps on the slot length is low, and like the chamber volume the slot length is limited by equipment restrictions. Due to the limitation of the equation (1), the slot gap H can not be simply reduced although the reduction is desirable. The equation (2) provides the extent of reduction of Pb/Ps, i.e., the permissible limit of the chamber size, slot length, slot gap, etc., for obtaining satisfactory coating.

Particularly, a dispersion coating liquid, such as magnetic dispersoids or thermal transfer type ink ribbon coating liquids, has a pseudoplastic property and is prone to coating film thickness fluctuations. In this case, the accuracy ΔH/H of the slot gap H and the pressure loss ratio Pb/Ps are set to as follows.

$$\Delta H/H \leqq 0.03 \quad (3)$$

$$Pb/Ps \leqq 0.06 \quad (4)$$

The dispersion coating liquid further usually has a coagulation property. It is thus desired to be in a flowing state in the chamber as well, which means an increase of Pb. In the case of the dispersion type coating liquid, however, unlike a coating liquid close to Newtonean coating liquids, the film thickness tends to be non-uniform in the coating width direction. In this case, when uniform thickness distribution is a first purpose, the upper limit of Pb/Ps is 0.06.

In the above embodiment, with the setting of the accuracy (i.e., coating width direction parallelness) ΔH/H of the slot 18 defined by the slot gap H and the coating width direction slot gap error ΔH in the range given by the equation (1) and also with the setting of the pressure loss Pb of the coating liquid 12 flowing in the chamber 17 in the coating width direction and the pressure loss Ps of the coating 12 flowing in the slot 18 in the range given by the equation (2), it is possible to suppress thickness fluctuations of the coating film in the coating width direction. Consequently, it is possible to realize a coating film having a uniform thickness in the coating width direction while taking the accuracy (or parallelness) of the slot gap into consideration with the pressure loss.

For a dispersion coating liquid such as a magnetic dispersoid as the coating material 12, which is liable to be coagulated in the chamber 17 and gives rise to thickness fluctuations of the coating film in the coating width direction, the accuracy ΔH/H of the slot gap H and the pressure loss ratio Pb/Ps are set as given by the equations (3) and (4), so that it is possible to realize a coating film having a uniform thickness in the coating width direction while taking the slot gap parallelness into consideration with the pressure loss and ensuring satisfactory coating film surface properties.

The above effects of the embodiment will be clarified by using results of experiments.

Figure 4:
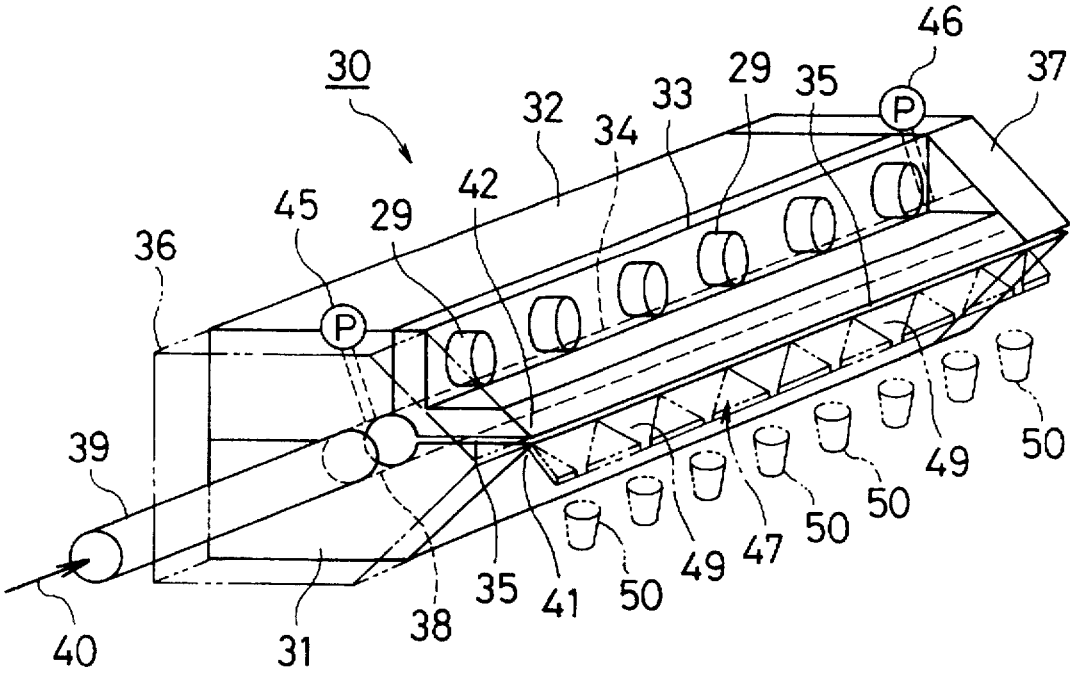
FIG. 4 is a perspective view showing a die used as experiment equipment.
Figure 5:
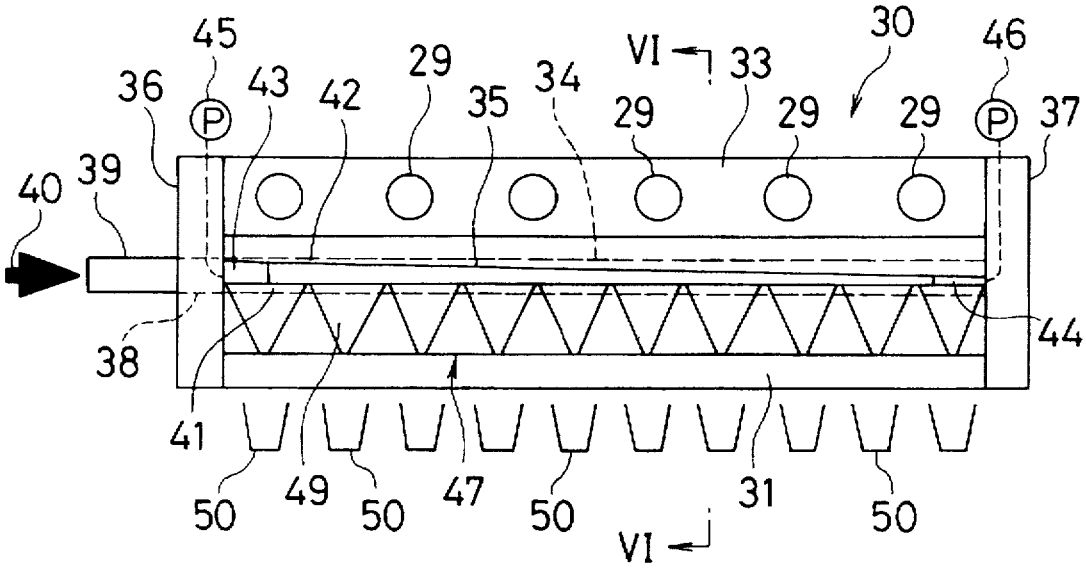
FIG. 5 is a front view showing the FIG. 4 die.
Figure 6:
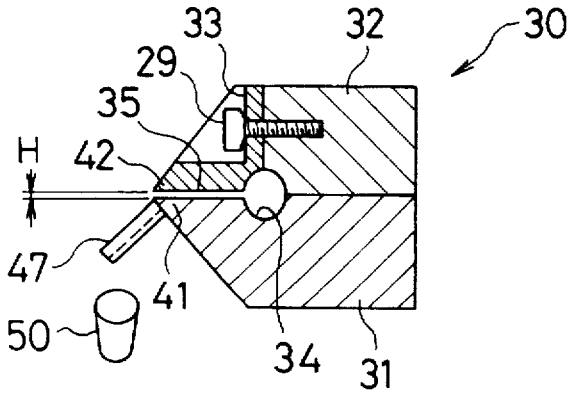
FIG. 6 is a sectional view taken along line VI—VI in FIG. 5.
Figure 7:
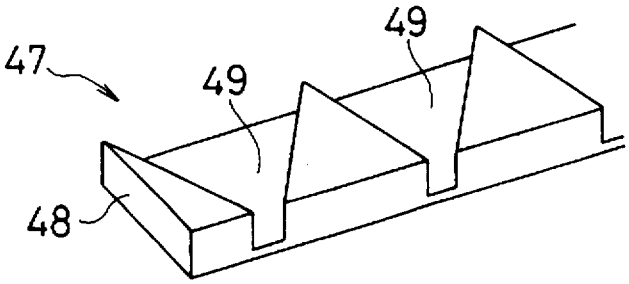
FIG. 7 is a perspective view showing a coating liquid separator in the FIGS. 4 to 6 die.
Figure 8:
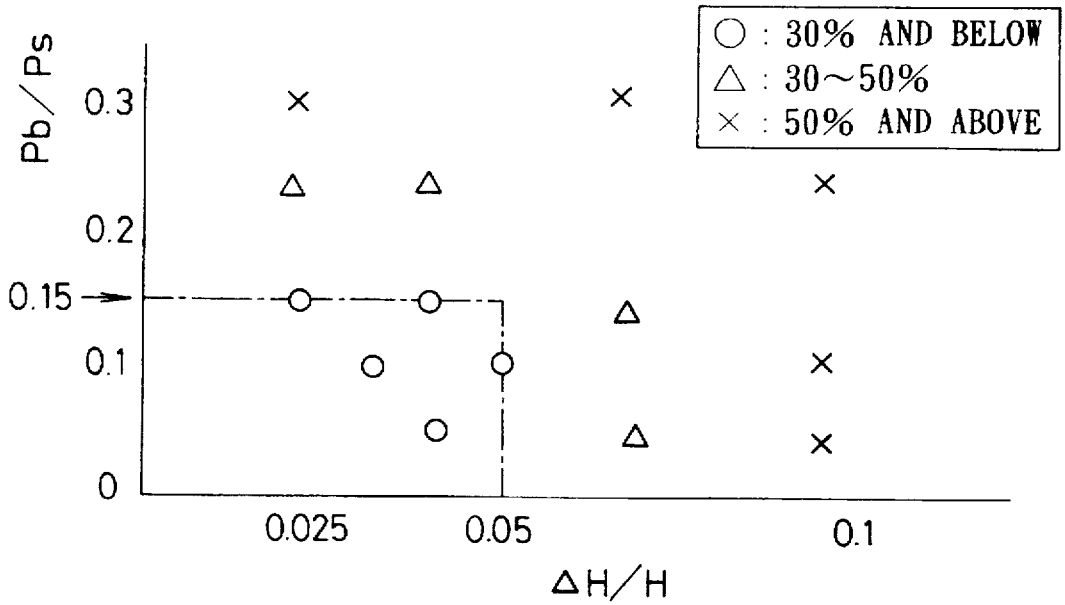
FIG. 8 is a graph showing the relationship of ΔH/H and Pb/Ps to the coating property of binder-diluted solutions.
Figure 9:
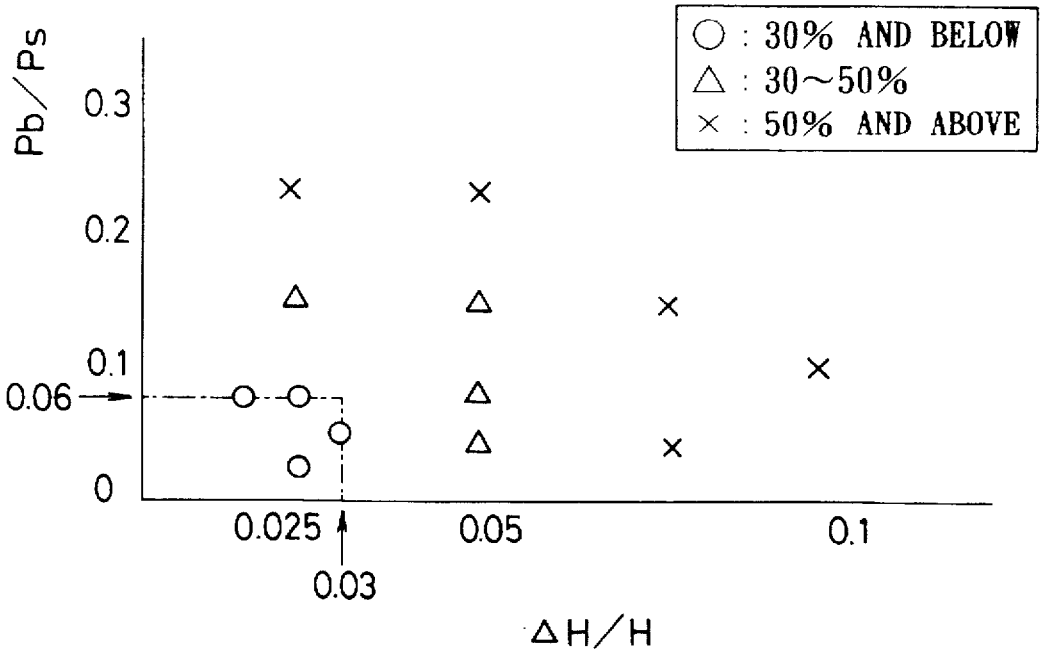
FIG. 9 is a graph showing the relationship of ΔH/H and Pb/Ps to the coating property of magnetic dispersoids.

FIG. 4 is a perspective view showing a die adopted as experimental equipment. FIG. 5 is a front view showing the FIG. 4 die. FIG. 6 is a sectional view taken along VI—VI in FIG. 5. FIG. 7 is a perspective view showing a coating liquid separator in the FIGS. 4 to 6 equipment. FIG. 8 is a graph showing the relationship of ΔH/H and Pb/Ps to the coating property of binder-diluted solutions. FIG. 9 is a graph showing the relationship of ΔH/H and Pb/Ps to the coating property of magnetic dispersoids.

As shown in FIGS. 4 to 6, used as the experimental equipment is a die 30, which is constructed by coupling a downstream stationary block 32 and a downstream movable block 33 to an upstream block 31 such that a chamber 34 and a slot 35 are defined between the opposed blocks.

The die 30 has a width of about 300 mm. The chamber 34 has the same cylindrical sectional profile in the width direction of the die 30, and it is communicated with the slot 35. The chamber 34 is defined by die side portions 36 and 37 disposed at the opposite ends of the die 30 in the width direction thereof. A coating liquid feeder 39 is connected to the die side portion 36. Coating liquid 40 from the coating liquid feeder 39 is fed through a coating liquid inlet 38, formed in the die side portion 36, to the chamber 34 and thence supplied to the slot 35.

The slot 35 is defined between upstream and downstream lips 41 and 42 formed at the tips of the upstream block 31 and downstream movable block 33. The slot gap H of the slot 35 is set by displacing the downstream movable block 33 toward or away from the upstream block 31 and then securing it with set bolts 29. In the present experiment, the slot gap H is set in a range of 100 to 1,000 μm.

The slot gap H is set to a desired value by providing shims 43 and 44 at the opposite ends of the slot 35 in the width direction of the die. In this experiment, the error ΔH of the slot gap H in the coating width direction is set by varying the thickness of the shims 43 and 44. In this experiment, the rate of discharge of coating liquid 40 from the slot 35, which varies with the slot gap H of the slot 35, is set to 10 to 1,000 cc/min.

The chamber 34 is provided with first and second pressure gauges 45 and 46 provided at one end on the side of the coating liquid inlet 38 and at the other end, respectively. Pressure values at the opposite ends of the chamber 34 are measured by this first and second pressure gauges 45 and 46. The absolute value of the difference between measurement values P1 and P2 obtained with the first and second pressure gauges 45 and 46, is calculated to determine the pressure loss Pb of the coating liquid 40 flowing in the chamber 34 in the coating width direction. In addition, the average value (P1+P2)/2 of the measurement values P1 and P2 is calculated and made to be the pressure loss Ps of the coating liquid 40 flowing in and out of the slot 35 (the pressure at the outlet of the slot 35 being made to be zero (i.e., atmospheric pressure)).

The experiment was conducted by using a binder-diluted solution showing Newtonean properties and a magnetic dispersoid coating liquid showing pseudoplastic properties as the coating liquid 40. The binder-diluted solution was prepared by diluting "VAGH" (manufactured by Union Carbide Co., Ltd.) with a blend solvent composed of methylethyl ketone, toluene and cyclohexanone to viscosities of 10 to 50 Cp. The magnetic dispersoid coating liquid was of a composition shown in Table 1.

TABLE 1

| Coating liquid composition (magnetic dispersoid coating liquid) | |
|---|---|
| Needle-like metal particles mainly composed of iron | 100 wt. parts |
| Alumina | 7 wt. parts |
| Carbon black | 3 wt. parts |
| Vinyl chloride-acrylic acid copolymer resin containing sulfonic acid group | 8 wt. parts |
| Polyurethane resin containing sulfonic acid group | 6 wt. parts |
| Stearic acid | 1 wt. parts |
| 2-ethylhexyl myristate | 2 wt. parts |
| Polyisocyanate | 4 wt. parts |
| Solvent (methylethyl ketone/ toluene/cyclohexanone = 2/1/2 | 230 wt. parts |

As shown in FIGS. 4 to 6, a coating liquid separator 47 was disposed on a portion of the upstream lip 41 near the slot 35 of the die 30, and the rate of flow of coating liquid 40 discharged from the slot 35 was measured. The coating liquid separator 47, as shown in FIG. 7, comprises flat plate-like member 48 with triangular paths 49 formed at a pitch of about 30 mm. Thus, it divides the slot 35, i.e., the coating liquid 40 discharged therefrom, into 10 divisions, for instance, in the coating width direction. The divisions of the coating liquid 40 are collected in respective measuring cups 50. The differences (or fluctuations) of the flow rate of coating liquid collected in the individual measuring cups 50 disposed in a row in the coating width direction correspond to the thickness fluctuations of the coating film in the coating width direction.

By directly measuring the rate of flow of the coating liquid 40 discharged from the slot 35 in the above way, it is possible to clarify the influence of the chamber 34, slot 35 and conditions of the coating operation on the thickness of the coating film.

In Experiment 1 using the binder-diluted solution as the coating liquid 40, as shown in FIG. 8, the flow rate fluctuations of the coating liquid 40 in the coating width direction (i.e., thickness fluctuations of the coating film in the coating width direction) are 30% and below as shown by circle marks (○) when the accuracy (or parallelness) ΔH/H of the slot gap H meets the equation (1) while the pressure loss ratio Pb/Ps meets the equation (2). In FIG. 8, cases when the flow rate fluctuations of the coating liquid 40 in the coating width direction are 30 to 50% are shown by triangle marks (Δ), and cases when the flow rate fluctuations are 50% and above are shown by cross marks (X).

In Experiment 2 using the magnetic dispersoid coating liquid as the coating liquid 40, as shown in FIG. 9, the flow rate fluctuations of the coating liquid 40 in the coating width direction (i.e., thickness fluctuations of the coating film in the coating width direction) are 30% and below as shown by circle marks (○) when the accuracy (or parallelness) ΔH/H of the slot gap H meets the equation (3) while the pressure loss ratio Pb/Ps meets the equation (4). Again in FIG. 9, cases when the flow rate fluctuations of the coating liquid 40 in the coating width direction are 30 to 50% are shown by triangle marks (Δ), and cases when the flow rate fluctuations are 50% and above are shown by cross marks (X).

Figure 10A:
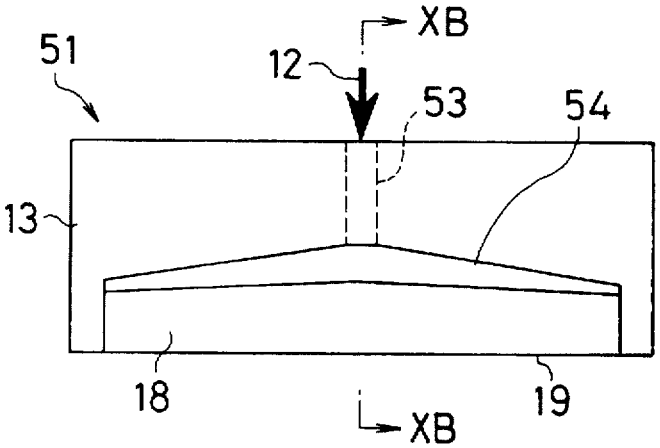
FIGS. 10A and 10B show a coat hanger chamber die adopting the coating apparatus according to the invention, FIG. 10A being a sectional view taken along line XA—XA in FIG. 10B, FIG. 10B being a sectional view taken along line XB—XB in FIG. 10A.
Figure 10B:
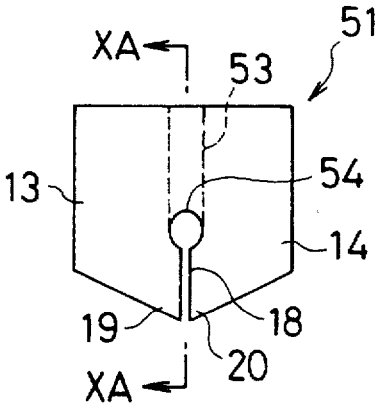
Figure 11A:
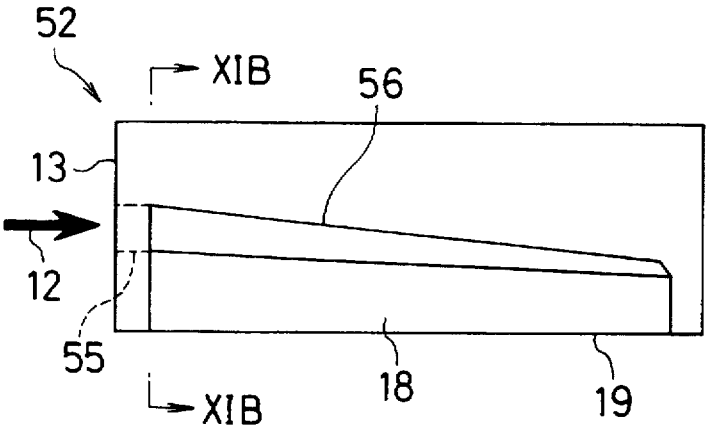
FIGS. 11A and 11B show a single hanger chamber die adopting the coating apparatus according to the invention, FIG. 11A being a sectional view taken along line XIA—XIA in FIG. 11B, FIG. 11B being a sectional view taken along line XIB—XIB in FIG. 11A.
Figure 11B:
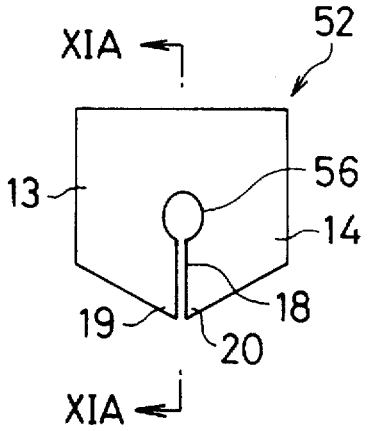

While the above embodiment of the coating apparatus 10 was a T die, the invention is also applicable to a coat hanger chamber die 51 as shown in FIGS. 10A and 10B and a single hanger chamber die 52 as shown in FIGS. 11A and 11B. In these two modifications, parts like those in the above embodiment are designated by like reference numerals, while omitting the description of these parts.

In the coat hanger chamber die 51, a coating liquid inlet 53 is provided in the width direction center of the die 51, and a chamber 54 communicated with the coating liquid inlet 53 is formed such that its sectional area becomes small as one goes away from the coating liquid inlet 53 in opposite directions. In the single hanger chamber die 52, a coating liquid inlet 55 is formed on one side portion of the die 52, and a chamber 56 communicated with the coating liquid inlet 55 is formed such that its sectional area becomes smaller as one goes away from the coating liquid inlet 55 in one direction. By using the coat hanger chamber die 51 or the single hanger chamber die 52, the thickness of the coating film can be made more uniform in the coating width direction.

The invention is further applicable to multiple chamber dies and paint circulation dies.

As has been described in the foregoing, with the coating apparatus according to the invention, it is possible to realize a coating film having a uniform thickness in the coating width direction while taking the parallelness of the slot gap into considerations.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A coating apparatus comprising at least one upstream lip and one downstream lip forming a uniform slot gap of a slot in a coating width direction, a chamber formed upstream of the slot, the chamber has a inlet through which a coating liquid is fed into said chamber and an end spaced from said inlet, a first pressure sensor for sensing a pressure P1 on said coating liquid in the chamber in vicinity of said inlet, a second pressure sensor at said end of said chamber for sensing a pressure P2 on said coating liquid in said chamber in the vicinity of said end, P1−P2 equals a pressure loss Pb of the coating liquid flowing in the chamber in the coating width direction and (P1+P2)÷2 equals a pressure loss Ps of the coating liquid flowing in the slot, said chamber arranged for distributing said coating liquid in the coating width direction, the coating liquid being coated on a support proceeding past the lips such that it is pressed against the support as it is discharged from the slot, wherein:

the slot gap H of the slot and the slot gap error ΔH in the coating width direction satisfy a relation:

$$0<\Delta H/H\leqq 0.05$$

and the pressure loss Pb and the pressure loss Ps satisfy a relation as follows:

$$Pb/Ps\leqq 0.15.$$

2. The coating apparatus according to claim 1, wherein:

$$0<\Delta H/H\leqq 0.03 \text{ and}$$

$Pb/Ps\leqq 0.06$ are satisfied when the coating liquid is a dispersion coating liquid.

3. In a method of coating using a coating liquid on a support web with a coating apparatus which has at least one upstream lip and one downstream lip forming a uniform slot gap of a slot in a coating with direction, a chamber formed upstream of the slot, the chamber having an inlet through which said coating liquid is fed into said chamber and an end spaced from said inlet, comprising sensing a first pressure P1 on said coating liquid in the chamber in the vicinity of said inlet, sensing a second pressure at said end of said chamber for sensing a pressure P2 on said coating liquid in said chamber in the vicinity of said end, wherein P1–P2 equals a pressure loss Pb of the coating liquid flowing in the chamber in the coating width direction and (P1+P2)÷2 equals a pressure loss Ps of the coating liquid flowing in the slot, arranging said chamber for distributing said coating liquid in the coating width direction, discharging said coating liquid on a support proceeding past the lips such that it is pressed against the support as it is discharged from the slot, wherein:

the slot gap H of the slot and the slot gap error ΔH in the coating width direction satisfy a relationship:

$$0<\Delta H/H\leqq 0.05$$

and the pressure loss Pb and the pressure loss Ps satisfy a relation as follows:

$$Pb/Ps\leqq 0.15.$$

4. The method of coating according to claim 3, wherein:

$$0<\Delta H/H\leqq 0.03 \text{ and}$$

$Pb/Ps\leqq 0.06$ are satisfied when the coating liquid is a dispersion coating liquid.

5. The coating apparatus according to claim 2, wherein:

said dispersion coating liquid is a magnetic dispersion coating liquid.

6. The method of coating according to claim 4, wherein:

said dispersion coating liquid is a magnetic dispersion coating liquid.

* * * * *